US010520262B2

(12) United States Patent
Choi et al.

(10) Patent No.: US 10,520,262 B2
(45) Date of Patent: Dec. 31, 2019

(54) HEAT EXCHANGER

(71) Applicant: SAMSUNG ELECTRONICS CO., LTD., Suwon (KR)

(72) Inventors: Yong Hwa Choi, Hwaseong (KR); Gaku Hayase, Suwon (KR); Young Min Kim, Suwon (KR); Won Joo Lee, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 899 days.

(21) Appl. No.: 14/065,838

(22) Filed: Oct. 29, 2013

(65) Prior Publication Data

US 2014/0116667 A1 May 1, 2014

(30) Foreign Application Priority Data

Oct. 29, 2012 (KR) ..... 10-2012-0120546
Jul. 3, 2013 (KR) ..... 10-2013-0077760

(51) Int. Cl.
*F28F 1/32* (2006.01)
*F28F 17/00* (2006.01)
*F28F 1/10* (2006.01)

(52) U.S. Cl.
CPC ..... *F28F 1/10* (2013.01); *F28F 1/325* (2013.01); *F28F 17/005* (2013.01); *F28F 2215/12* (2013.01)

(58) Field of Classification Search
CPC ..... F28F 1/10; F28F 1/12; F28F 1/325; F28F 17/005; F28F 2215/12
(Continued)

(56) References Cited

U.S. PATENT DOCUMENTS 4,365,667 A * 12/1982 Hatada ..... F28F 1/325 165/151
4,709,753 A * 12/1987 Reifel ..... F28F 1/325 165/151
(Continued)

FOREIGN PATENT DOCUMENTS

CN 1573271 A 2/2005
CN 1809721 7/2006
(Continued)

OTHER PUBLICATIONS

Partial European Search Report dated Oct. 19, 2016 in corresponding European Patent Application No. 13 19 0525.9.
(Continued)

*Primary Examiner* — Leonard R Leo
(74) *Attorney, Agent, or Firm* — Staas & Halsey LLP

(57) ABSTRACT

A heat exchanger is provided capable of suppressing formation of frost, thereby achieving enhanced heat exchange efficiency refrigerator. The heat exchanger includes refrigerant tubes vertically spaced apart from one another, and heat exchanging fins spaced apart from another in a longitudinal direction of the refrigerant tubes while being coupled to surfaces of the refrigerant tubes. Each heat exchanging fin includes fitting slots formed at one lateral end of the heat exchanging fin and vertically arranged to receive a plurality of refrigerant tubes, and moisture guide valleys extending vertically to downwardly guide moisture on the heat exchanging fin. Each moisture guide valley includes a first moisture guide valley arranged along a virtual line extending through a boundary between a curved portion of the corresponding fitting slot and each straight portion of the fitting slot, and a second moisture guide valley to guide moisture to the first moisture guide valley.

19 Claims, 14 Drawing Sheets

(58) Field of Classification Search
USPC ..... 165/151, 181, 182, 146
See application file for complete search history.

(56) References Cited

U.S. PATENT DOCUMENTS

| | | | | |
|---|---|---|---|---|
| 4,832,117 | A * | 5/1989 | Kato | F28F 1/325 165/151 |
| 5,203,403 | A * | 4/1993 | Yokoyama | F28F 1/32 165/151 |
| 9,316,446 | B2 * | 4/2016 | Yoshioka | F28F 1/325 |
| 2004/0251016 | A1 | 12/2004 | Oh et al. | |
| 2008/0190589 | A1 | 8/2008 | Kramer | |
| 2010/0089562 | A1 | 4/2010 | Shibata et al. | |

FOREIGN PATENT DOCUMENTS

| | | | | |
|---|---|---|---|---|
| JP | 58-184439 | | 10/1983 | |
| JP | 02071096 | A * | 3/1990 | |
| JP | 02251093 | A * | 10/1990 | F28F 17/005 |
| JP | 03095394 | A * | 4/1991 | F28F 1/325 |
| JP | 9-324995 | | 12/1997 | |
| JP | 2834339 | | 10/1998 | |
| JP | 2000234883 | A * | 8/2000 | F28F 17/005 |
| JP | 2011-064403 | | 3/2011 | |
| JP | 2011-64403 | A | 3/2011 | |
| JP | 2012-163321 | | 8/2012 | |
| KR | 10-2005-0042182 | | 4/2005 | |
| KR | 10-2008-0032340 | | 4/2008 | |
| WO | WO 2012/098921 | | 7/2012 | |

OTHER PUBLICATIONS

Chinese Office Action dated Dec. 2, 2016 in corresponding Chinese Patent Application No. 201310522803.9.
European Search Report dated Apr. 4, 2017 in corresponding European Application No. 13 19 0525.
Chinese Office Action dated Aug. 3, 2017 in corresponding Chinese Patent Application No. 201310522803.9.
European Intention to Grant dated Nov. 17, 2017 in corresponding European Application No. 13 190 525.9.
Office Action dated Feb. 27, 2018, in corresponding Chinese Patent Application No. 201310522803.9, 7 pgs.
Chinese Patent Office issued the Fourth Office Action in Chinese Patent Application No. 201310522803.9 dated Jan. 4, 2019 (26 Total pages).
Korean Office Action dated Aug. 19, 2019 in Korean Patent Application No. 10-2013-0077760.

* cited by examiner

HEAT EXCHANGER

CROSS-REFERENCE TO RELATED APPLICATIONS

This application is related to, and claims priority to, Korean Patent Application Nos. 10-2012-0120546 and 10-2013-0077760, respectively filed on Oct. 29, 2012 and Jul. 3, 2013 in the Korean Intellectual Property Office, the disclosures of which are incorporated herein by reference.

BACKGROUND

1. Field

Embodiments of the present invention relate to a heat exchanger having an improved structure capable of suppressing formation of frost, thereby achieving an enhancement in heat exchange efficiency.

2. Description of the Related Art

A heat exchanger is a device disposed within an appliance using a refrigeration cycle such as an air conditioner or a refrigerator.

Such a heat exchanger includes a plurality of heat exchanging fins, and refrigerant tubes extending through the heat exchanging fins, to guide refrigerant. The heat exchanging fins increase the contact area of the refrigerant tubes contacting ambient air introduced into the heat exchanger, thereby enhancing heat exchange efficiency of the refrigerant flowing through the refrigerant tubes to exchange heat with ambient air.

Such a heat exchanger may function as an evaporator or a condenser, to enable cooling or heating operation of the refrigeration cycle.

During heating operation in which the heat exchanger may function as an evaporator, cold ambient air, which is cooler than the heat exchanging fins, passes around the heat exchanging fins. When cold ambient air passes around the heat exchanging fins, moisture contained in the ambient air forms frost on the surfaces of the heat exchanging fins, thereby reducing heat exchange efficiency of the heat exchanger.

SUMMARY

Additional aspects and/or advantages will be set forth in part in the description which follows and, in part, will be apparent from the description, or may be learned by practice of the invention.

It is an aspect of the present invention to provide a heat exchanger having a structure capable of suppressing formation of frost on the surfaces of heat exchanging fins.

Additional aspects of the invention will be set forth in part in the description which follows and, in part, will be obvious from the description, or may be learned by practice of the invention.

In accordance with an aspect of the present invention, a heat exchanger includes a plurality of refrigerant tubes vertically spaced apart from one another, and a plurality of heat exchanging fins spaced apart from another in a longitudinal direction of the refrigerant tubes, each of the heat exchanging fins being coupled to a surface of at least one of the refrigerant tubes, wherein each of the heat exchanging fins includes a plurality of fitting slots formed at one lateral end of the heat exchanging fin while being vertically arranged to receive the plurality of refrigerant tubes, and a plurality of moisture guide valleys extending vertically to downwardly guide moisture formed on a surface of the heat exchanging fin, wherein each of the moisture guide valleys includes a first moisture guide valley arranged along a virtual line extending through a boundary between a curved portion of a corresponding one of the fitting slots and each straight portion of the fitting slot, and a second moisture guide valley to guide moisture to the first moisture guide valley.

Each of the moisture guide valleys may include a second moisture guide valley to guide moisture to the first moisture guide valley.

Each of the heat exchanging fins may include a protrusion protruded in a direction away from the refrigerant tubes. The second moisture guide valley may be arranged to be closer to the protrusion than the first moisture guide valley.

Each of the heat exchanging fins may include contact ribs each extending around a corresponding one of the fitting slots in a longitudinal direction of a corresponding one of the refrigerant tubes, to contact the surface of the corresponding refrigerant tube, and moisture guide surfaces each extending around a corresponding one of the fitting slots outside a corresponding one of the contact ribs while being inclined toward the corresponding contact rib. Each of the moisture guide surfaces may intersect the first moisture guide valley of a corresponding one of the moisture guide valleys.

Each of the heat exchanging fins may include a flat surface provided between a corresponding one of the contact ribs and a corresponding one of the moisture guide surfaces, to be perpendicular to a corresponding one of the refrigerant tubes.

Each of the heat exchanging fins may include a spacer protruded from the surface of the heat exchanging fin, to space the heat exchanging fins by a predetermined distance.

Each of the spacers may include a first spacer provided on a virtual line horizontally extending from a corresponding one of the fitting slots in an insertion direction of the refrigerant tubes.

Each of the spacers may include a first spacer and a second spacer, and a corresponding one of the fitting slots is disposed between the first spacer and the second spacer.

The first spacer may be arranged to be closer to the curved portion of the corresponding fitting slot than the second spacer.

The first and second spacers may include extensions extending from the corresponding fitting slot toward the heat exchanging fin, respectively. A sum of widths of the extensions in the first and second spacers may be approximately 60% or more of a width of the corresponding fitting slot.

The width of the extension of the first spacer may be greater than the width of the extension of the second spacer.

Each of the heat exchanging fins may further include louvers each provided between adjacent ones of the fitting slots.

Each of the louvers may include a plurality of guide plates extending in parallel with a corresponding one of the moisture guide valleys while being spaced apart from one another in a longitudinal direction of the fitting slots. Each of the guide plates may be bent to have multiple steps in a width direction of the guide plates.

Each of the louvers may include a first louver having one guide plate for each column, and a second louver having two guide plates spaced apart from each other for each column.

Each of the heat exchanging fins may include moisture guide surfaces each extending around a corresponding one of the fitting slots while being inclined toward the corresponding fitting slot. The first louver may be arranged in a first region where at least a portion of a corresponding one of the moisture guide surfaces, and the second louver is arranged in a second region other than the first region.

A relation of "(D1*D2)^0.3/D3>1.5" may be established when it is assumed that "D1" represents a length of the protrusion, "D2" represents a width of each fin portion of the heat exchanging fin between adjacent ones of the fitting slots, and "D3" represents a maximum width of the fitting slots.

In accordance with an aspect of the present invention, a heat exchanger includes a plurality of refrigerant tubes vertically spaced apart from one another, and a plurality of heat exchanging fins spaced apart from another in a longitudinal direction of the refrigerant tubes, each of the heat exchanging fins being coupled to a surface of at least one of the refrigerant tubes, wherein each of the heat exchanging fins includes a plurality of fitting slots formed at one lateral end of the heat exchanging fin while being vertically arranged to receive the plurality of refrigerant tubes, a plurality of moisture guide valleys extending vertically to downwardly guide moisture formed on surfaces of the heat exchanging fin, and spacers protruded to space the heat exchanging fins by a predetermined distance, wherein each of the spacers includes first and second spacers provided in the vicinity of a corresponding one of the fitting slots, to be arranged in an insertion direction of the refrigerant tubes.

The first spacer may be arranged in the vicinity of a curved portion of the corresponding fitting slot.

The first spacer may be arranged in the vicinity of a straight portion of the corresponding fitting slot.

The first and second spacers may include extensions extending from the corresponding fitting slot toward the heat exchanging fin, respectively. A sum of widths of the extensions in the first and second spacers may be approximately 60% or more of a width of the corresponding fitting slot.

In accordance with an aspect of the present invention, a heat exchanger includes a plurality of refrigerant tubes vertically spaced apart from one another, and a plurality of heat exchanging fins spaced apart from another in a longitudinal direction of the refrigerant tubes, each of the heat exchanging fins being coupled to surfaces of the refrigerant tubes, wherein each of the heat exchanging fins includes a plurality of fitting slots formed at one lateral end of the heat exchanging fin while being vertically arranged to receive the plurality of refrigerant tubes, and a protrusion protruded in a direction away from the refrigerant tubes, wherein a relation of "(D1*D2)^0.3/D3>1.5" is established when it is assumed that "D1" represents a length of the protrusion, "D2" represents a width of each fin portion of the heat exchanging fin between adjacent ones of the fitting slots, and "D3" represents a maximum width of the fitting slots.

Each of the heat exchanging fins may include a plurality of moisture guide valleys extending vertically to downwardly guide moisture formed on surfaces of the heat exchanging fin. Each of the moisture guide valleys may include a first moisture guide valley arranged along a virtual line extending through a boundary between a curved portion of a corresponding one of the fitting slots and each straight portion of the fitting slot, and a second moisture guide valley arranged to be closer to the protrusion than the first moisture guide valley, to guide moisture to the first moisture guide valley.

Each of the heat exchanging fins may further include contact ribs each extending around a corresponding one of the fitting slots in a longitudinal direction of a corresponding one of the refrigerant tubes, to contact the surface of the corresponding refrigerant tube, and moisture guide surfaces each extending around a corresponding one of the fitting slots outside a corresponding one of the contact ribs while being inclined toward the corresponding contact rib. Each of the moisture guide surfaces may intersect the first moisture guide valley of a corresponding one of the moisture guide valleys.

Each of the heat exchanging fins may include at least one spacer protruded from the surface of the heat exchanging fin, to space the heat exchanging fins by a predetermined distance.

Each of the heat exchanging fins may include louvers each provided between adjacent ones of the fitting slots. Each of the louvers may include a plurality of guide plates spaced apart from one another in a longitudinal direction of the fitting slots. Each of the guide plates may be bent to have multiple steps in a width direction of the guide plates.

Each of the louvers may include a first louver having one guide plate for each column, and a second louver having two guide plates spaced apart from each other for each column.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Reference will now be made in detail to the exemplary embodiments of the present invention, examples of which are illustrated in the accompanying drawings.

Figure 1:
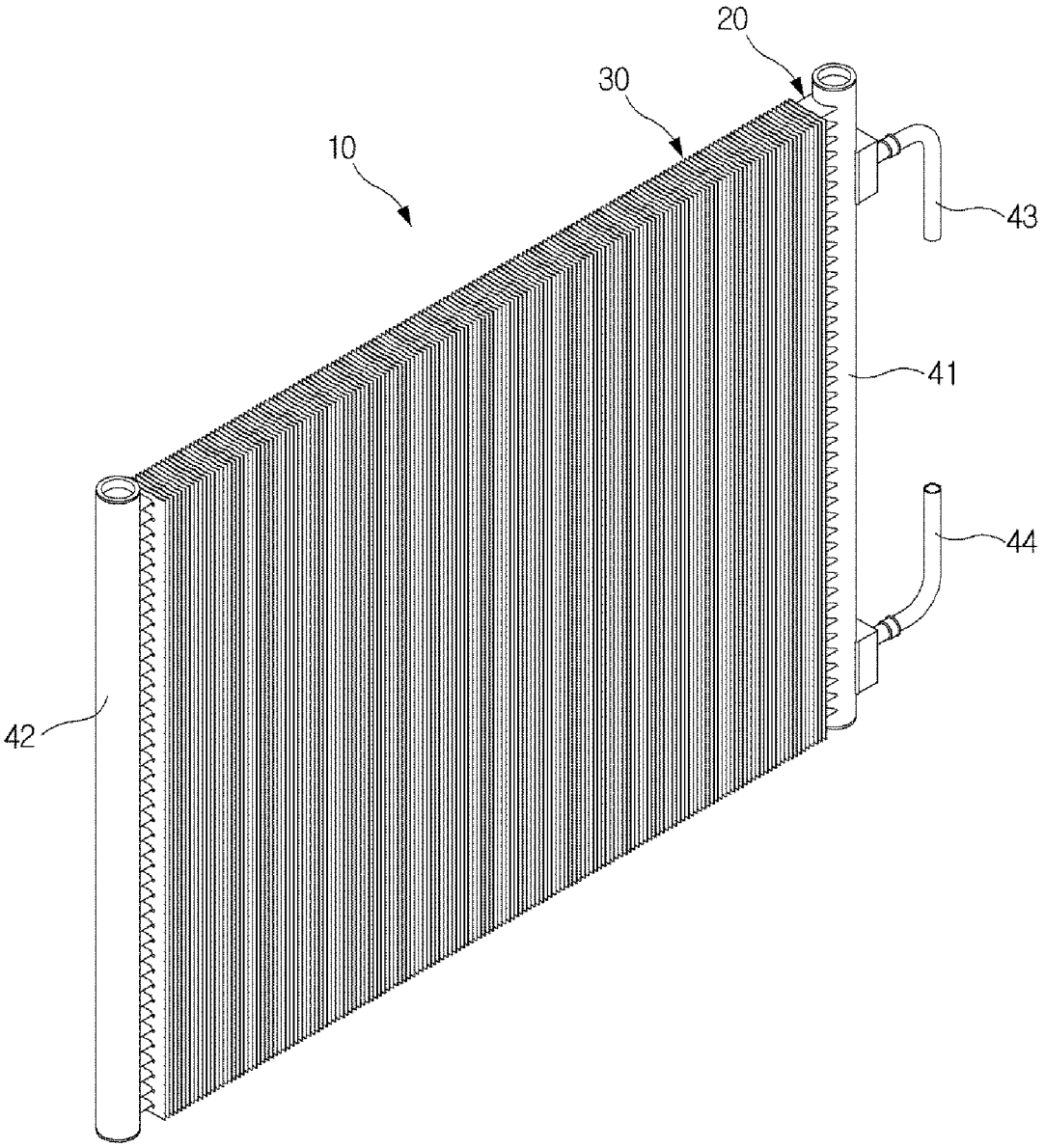
FIG. 1 illustrates a heat exchanger according to an embodiment of the present invention.
Figure 2:
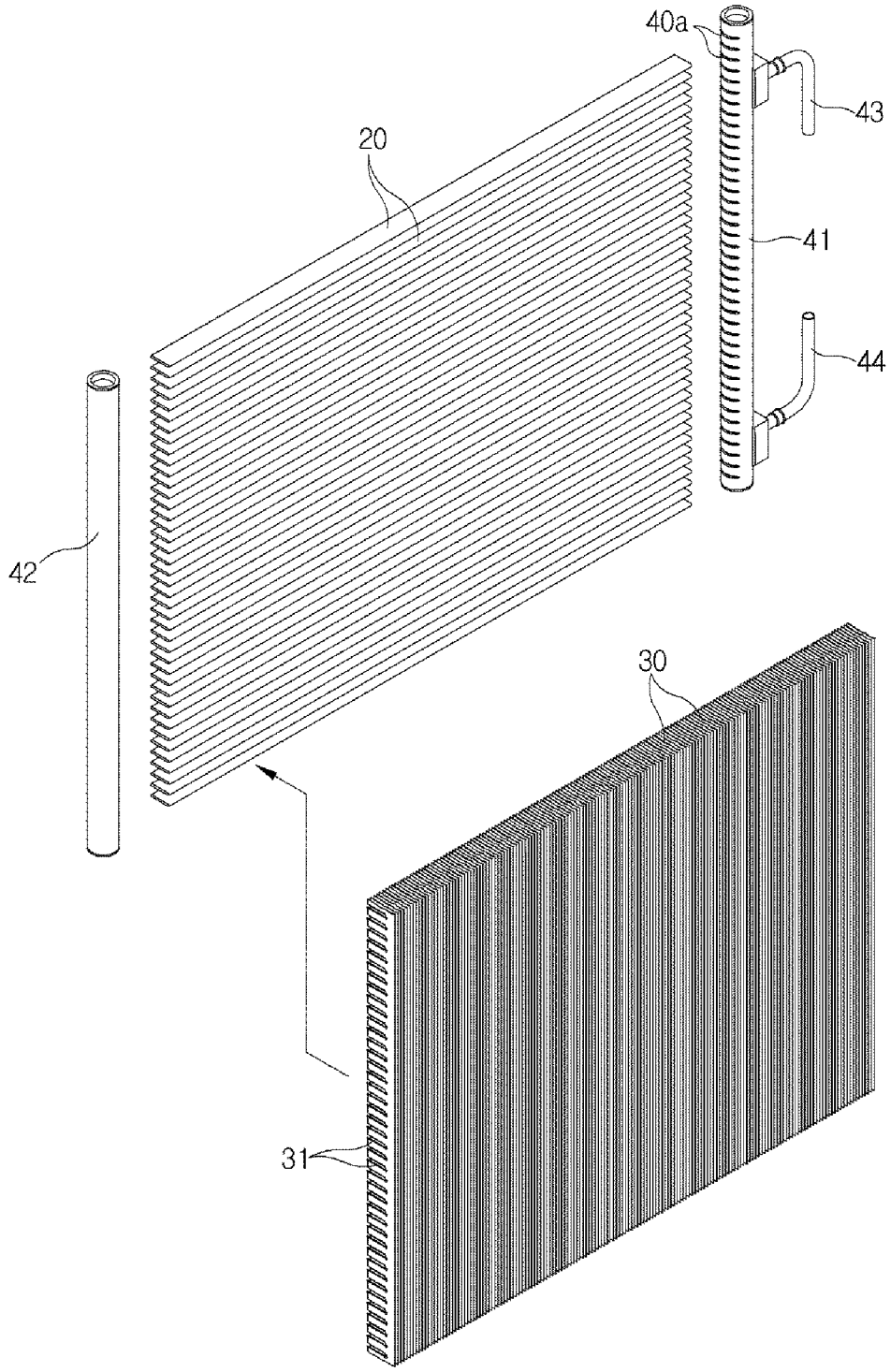
FIG. 2 illustrates an exemplary heat exchanger.

FIG. 1 illustrates an exemplary heat exchanger according to an embodiment of the present invention. FIG. 2 illustrates an exemplary heat exchanger.

As illustrated in FIGS. 1 and 2, the heat exchanger, which is designated by reference character "10", includes a plurality of refrigerant tubes 20, through which refrigerant flows, and a plurality of heat exchanging fins 30 coupled to outer surfaces of the refrigerant tubes 20. The heat exchanger 10 also includes a first header 41 and a second header 42, which are coupled to opposite ends of the refrigerant tubes 20, respectively.

Figure 3:
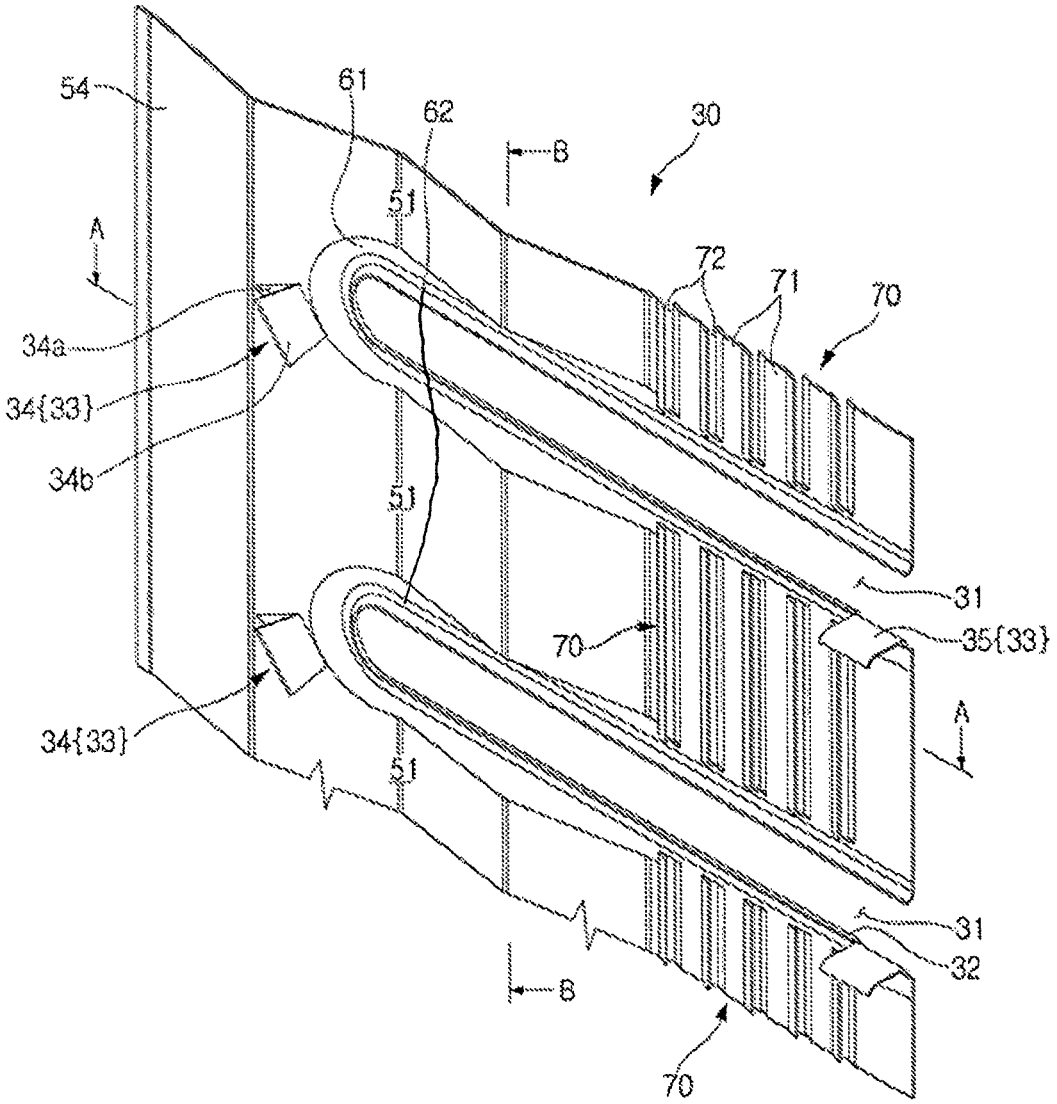
FIG. 3 illustrates heat exchanging fins according to an embodiment of the present invention.

Each of the refrigerant tubes 20 may have a flat plate shape, and include a plurality of passages 21 formed in a hollow body of the refrigerant tube 20, and partition walls 22 to partition the passages 21 (see, for example, FIG. 3). The passages 21 of each refrigerant tube 20 may be spaced apart from one another in a width direction of the refrigerant tube 20. The plural refrigerant tubes 20 may be vertically spaced apart from one another.

The refrigerant exchanges heat with ambient air while performing a phase change from a gas phase to a liquid phase (compression) or performing a phase change from a liquid phase to a gas phase (expansion). When the refrigerant performs a phase change from a gas phase to a liquid phase, the heat exchanger 10 may function as a condenser. When the refrigerant performs phase change from a liquid phase to a gas phase, the heat exchanger 10 may function as an evaporator.

The first header 41 and second header 42, which are coupled to opposite ends of the refrigerant tubes 20, connect the refrigerant tubes 20 such that the refrigerant flows through the refrigerant tubes 20. Each of the first and second headers 41 and 42 may have a tubular shape. Each of the first and second headers 41 and 42 may be provided, at one side thereof, with coupling slots 40*a*, to which respective one-side ends of the refrigerant tubes 20 are coupled. In order to guide flow of the refrigerant sequentially passing through the refrigerant tubes 20, the inner space of each of the headers 41 and 42 may be vertically divided into a plurality of sub-spaces corresponding to respective refrigerant tubes 20. A refrigerant inlet tube 43 and a refrigerant outlet tube 44 may be connected to the first header 41, to guide a flow of refrigerant introduced into the heat exchanger 10 and a flow of refrigerant emerging from the heat exchanger 10.

The refrigerant discharges or absorbs heat into, or from, ambient air as it is condensed or expanded while flowing through the passages 21 formed in the refrigerant tubes 20. In order to allow the refrigerant to efficiently discharge or absorb heat during condensation or expansion thereof, a heat exchanging fin 30 may be coupled to an outer surface of a refrigerant tube 20.

The heat exchanging fin 30 may be provided in plural such that they are spaced apart from one another by a predetermined distance in a longitudinal direction of the refrigerant tubes 20. Since the heat exchanging fins 30 may be joined to the outer surfaces of the refrigerant tubes 20, they function to increase the area of the refrigerant tubes 20 exchanging heat with ambient air passing among the heat exchanging fins 30.

Figure 4:
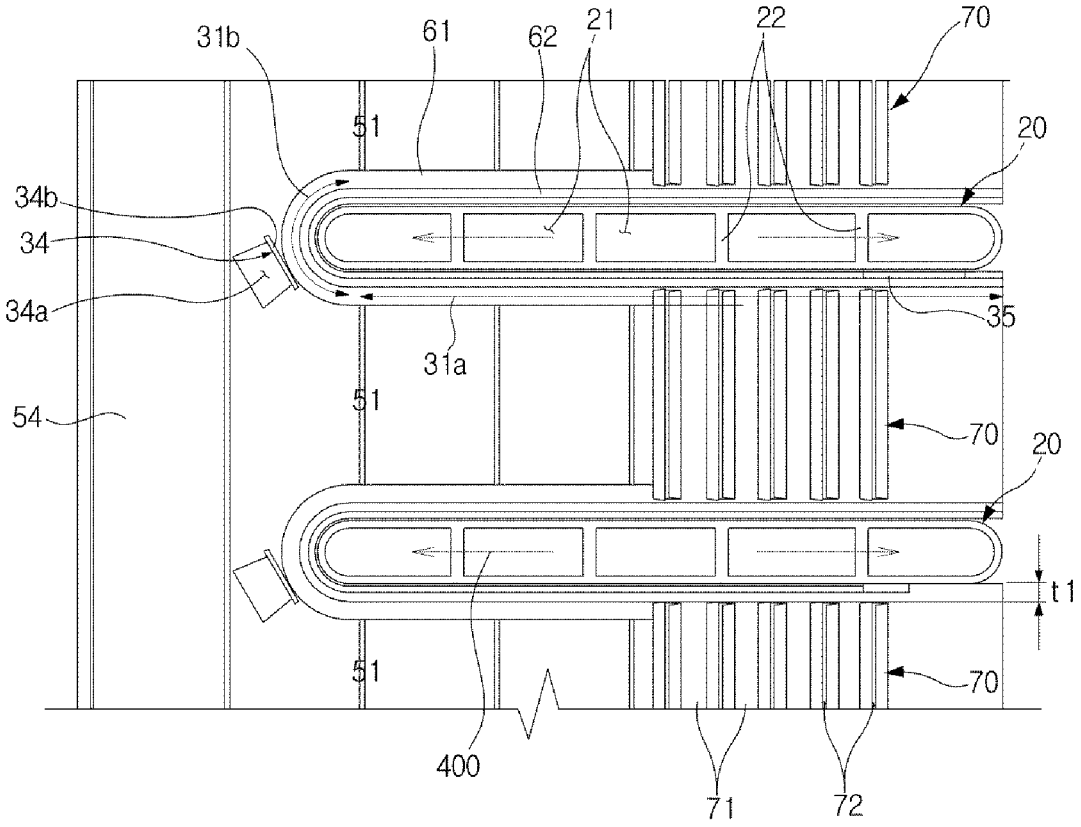
FIG. 4 is an exemplary plan view of the heat exchanging fins illustrated in FIG. 3.
Figure 5:
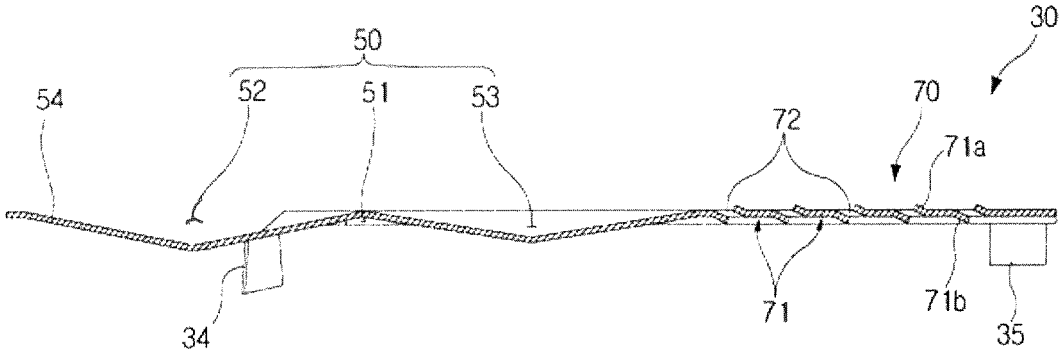
FIG. 5 is an exemplary cross-sectional view taken along line A-A in FIG. 3.
Figure 6:
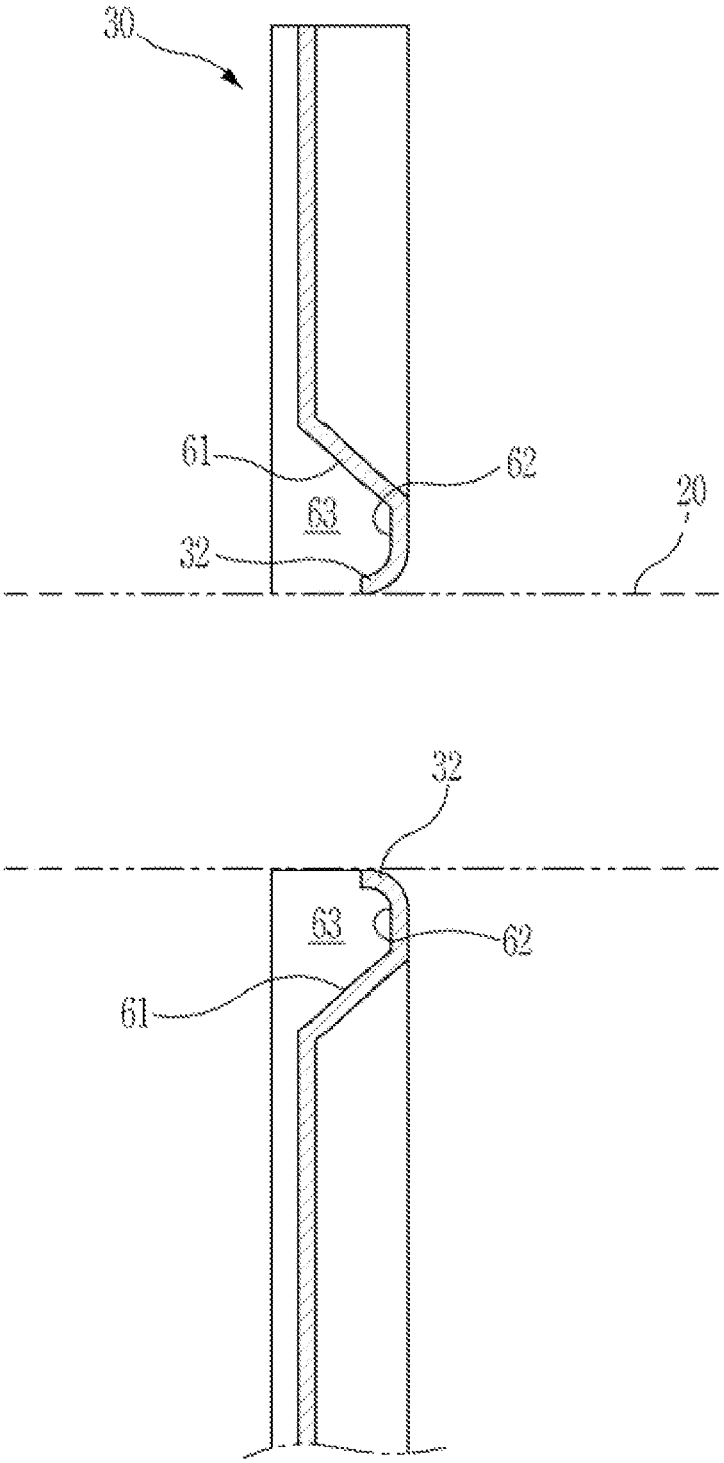
FIG. 6 is an exemplary cross-sectional view taken along line B-B in FIG. 3.

FIG. 3 is a perspective view of a heat exchanger illustrating the heat exchanging fins according to an exemplary embodiment of the present invention. FIG. 4 is a plan view of exemplary heat exchanging fins illustrated in FIG. 3. FIG. 5 is a cross-sectional view taken along line A-A in FIG. 3. FIG. 6 is a cross-sectional view taken along line B-B in FIG. 3.

As illustrated in FIGS. 3 to 6, the heat exchanging fins 30, which may have a plate shape, extend vertically. Each heat exchanging fin 30 may be formed, at one lateral end thereof, with fitting slots 31 for coupling of the heat exchanging fin 30 with respective refrigerant tubes 20. The fitting slots 31 are provided in plural while being spaced apart from one another in a longitudinal direction of the heat exchanging fin 30, namely, a vertical direction. Thus, a plurality of refrigerant tubes 20 may be simultaneously coupled to each heat exchanging fin 30.

To join each heat exchanging fin 30 with the refrigerant tubes 20, a contact rib 32 may be provided around each fitting slot 31 of the heat exchanging fin 30, to extend in the longitudinal direction of the corresponding refrigerant tube 20 so as to contact a surface of the corresponding refrigerant tube 20.

Each fitting slot 31 is bounded by opposite straight portions 31*a* and a curved portion 31*b* of the fin 30. The curved portion 31*b* may connect the opposite straight portions 31*a* of the fin 30.

Each heat exchanging fin 30 may include a protrusion 54 protruding beyond the refrigerant tubes 20. That is, the protrusion 54 may be a portion of the heat exchanging fin 30 protruded outwardly of the heat exchanger 20 beyond the refrigerant tubes 20, which are fitted in respective fitting slots 31.

At least one spacer 33 may be provided at each heat exchanging fin 30 in order to space the heat exchanging fins 30 from one another by a predetermined distance in the longitudinal direction of the refrigerant tubes 20. The spacer 33 may protrude from the corresponding heat exchanging fin 30 in an arrangement direction of the heat exchanging fins 30 in order to support the corresponding heat exchanging fin 30 and the heat exchanging fin 30 arranged adjacent to the corresponding heat exchanging fin 30 such that a desired space is maintained between adjacent heat exchanging fins 30. According to an exemplary embodiment, a plurality of spacers 33 may be provided at each heat exchanging fin 30 in order to support the corresponding heat exchanging fin 30 and the heat exchanging fin 30 arranged adjacent to the corresponding heat exchanging fin 30 in a balanced state.

During a heating operation in which the heat exchanger 10 is used as an evaporator, cold ambient air, which is cooler than the heat exchanging fins, passes around the heat exchanging fins 30. When cold ambient air passes around the heat exchanging fins 30, moisture contained in the ambient air may form frost on the surfaces of the heat exchanging fins 30. As a result, there may be a possibility of a reduction in heat exchange efficiency of the heat exchanger 10.

The heat exchanging fins 30 may be configured to easily downwardly drain moisture including condensed water formed on the surfaces of the heat exchanging fins 30 in order to suppress formation of frost.

That is, each heat exchanging fin 30 may be provided with a plurality of moisture guide valleys 50. In order to provide the moisture guide valleys 50 at front and back surfaces of each heat exchanging fin 30, each heat exchanging fin 30 may be bent several times in a substantially width direction thereof at portions thereof disposed away from, and toward, the fitting slots 31. Thus, moisture formed on the surfaces of the heat exchanging fin 30 may be rapidly drained toward a lower end of the heat exchanging fin 30 along the moisture guide valleys 50 after being collected in the moisture guide valleys 50. According to an exemplary embodiment of the present invention, the moisture guide valleys 50 of each heat exchanging fin 30 includes first to third moisture guide valleys 51, 52, and 53 spaced apart from one another in a width direction of the heat exchanging fin 30.

As illustrated in FIG. 4, condensed water formed on the outer surface of each refrigerant tube 20 may be collected at opposite lateral ends of the refrigerant tube 20 along the outer surface of the refrigerant tube 20. In FIG. 4, flow direction(s) of condensed water flowing along the surface of the refrigerant tubes 20 is indicated by arrows 400.

In order to downwardly drain condensed water collected at the lateral end of each refrigerant tube 20 inwardly disposed in the insertion direction of the refrigerant tube 20, the first moisture guide valley 51 may be arranged along a line extending through a boundary between the curved portion 31*b* of the fitting slot 31 and each straight portion 31*a* of the fitting slot 31. That is, the first moisture guide valley 51 may be arranged to correspond to the inner end of the fitting slot 31. A "corresponding to the inner end" may be defined as including a case in which the first moisture guide valley 51 is aligned with the inner end, and a case in which the first moisture guide valley 51 is arranged adjacent to opposite sides of the inner end. The second moisture guide valley 52 may be arranged to guide moisture toward the first moisture guide valley 51. The distance between the second moisture guide valley 52 and the protrusion 54 may be shorter than the distance between the first moisture guide valley 51 and the protrusion 54.

The first moisture guide valleys 51, which may be provided in plural, may be vertically aligned in order to downwardly drain condensed water received from the plural refrigerant tubes 20 after sequentially collecting the condensed water.

Each heat exchanging fin 30 includes a moisture guide surface 61 extending around each fitting slot 31 outside the contact rib 32 while being inclined toward the contact rib 32. The heat exchanging fin 30 includes a flat surface 62 disposed between the moisture guide surface 61 and the contact rib 32 while extending around the fitting slot 31 in a direction perpendicular to the corresponding refrigerant tube 20.

As illustrated in FIG. 6, the moisture guide surface 61 defines a guide groove 63 to downwardly guide condensed water, for example, collected from above in accordance with an inclination thereof while guiding, in the width direction of the refrigerant tubes 20, the condensed water between the corresponding refrigerant tube 20 and the refrigerant tube 20 disposed adjacent to the corresponding refrigerant tube 20. Accordingly, it may be possible to promote flow of condensed water along the surfaces of the refrigerant tubes 20. The flat surface 62 may reduce flow resistance of ambient air, and thus achieve more rapid flow of condensed water along the guide groove 63.

The moisture guide surface 61 intersects a corresponding first moisture guide valleys 51 at a position toward the inner lateral end of the corresponding fitting slot 31 and, as such, condensed water reaching a position adjacent to the corresponding first moisture guide valley 51 along the guide groove 63 may be downwardly drained along the corresponding first moisture guide valley 51.

Each spacer 33 may be disposed around the corresponding fitting slot 31 in order to prevent an increase in the flow resistance of air flowing among the heat exchanging fins 30. According to an exemplary embodiment, each spacer 33 contributes to an enhancement in condensed water drainage performance.

Each spacer 33 may include a first spacer 34 disposed on the corresponding heat exchanging fin 30 at a position on a virtual horizontal extension line of the fitting slot 31 extending in the insertion direction of the corresponding refrigerant tube 20. The spacer 33 may include a second spacer 35 provided at the contact rib 32 of the corresponding fitting slot 31 at a position opposite to the first spacer 34 while being integrated with the contact rib 32.

The first spacer 34 may have a cut structure formed, for example, by cutting a portion of the heat exchanging fin 30, to form an opening 34*a* while keeping the cut portion, and then bending the cut portion from the opening 34*a* in the arrangement direction of the heat exchanging fins 30. The second spacer 35 may be formed by a plate portion, which remains without being removed in a procedure of cutting out a plate (not shown) in order to form the contact rib 32 for manufacture of the heat exchanging fin 30.

The first spacer 34 has an inclined surface 34*b* to guide moisture toward the corresponding first moisture guide valley 51. The inclined surface 34*b* meets the moisture guide surface 61 above the corresponding first moisture guide valley 51 at an end of the inclined surface 34*b* in an inclination direction of the inclined surface 34*b*. Thus, the first spacer 34 achieves an enhancement in condensed water drainage performance by virtue of the inclined surface 34*b* guiding moisture toward the first moisture guide valley 51.

The first spacer 34 may have a cut structure integrated with the heat exchanging fin 30 According to an exemplary embodiment, the first spacer 34 may be a separate member attached to the heat exchanging fin 30, with the member having an inclined surface 34*b* to guide moisture toward the first moisture guide valley 51.

A louver 70 may be provided at each heat exchanging fin 30 between adjacent fitting slots 31 in order to achieve an enhancement in condensed water drainage performance.

The louver 70 includes a plurality of guide plates 71 spaced apart from one another in the longitudinal direction of the fitting slots 31 while extending in parallel with the moisture guide valleys 50. Each guide plate 71 may have a cut structure. As illustrated in FIG. 3, for example, reference character "72" designates an opening, i.e., opening 72 formed in accordance with cutting of the heat exchanging fin 30 for formation of each guide plate 71.

The louver 70 may guide air flowing between the corresponding heat exchanging fins 30 toward the corresponding refrigerant tubes 20, and thus to promote a heat exchanging function. The plural guide plates 71, which are spaced apart from one another, may be inclined toward the corresponding refrigerant tubes 20 in parallel, to guide air toward the refrigerant tubes 20 through the openings 72.

The guide plates 71, which are formed between the adjacent fitting slots 31, not only promote a heat exchanging function, but also may perform a condensed water drainage function of downwardly guiding condensed water from above.

That is, the guide plates 71 perform a function of sucking moisture from positions adjacent thereto in accordance with capillary action. Moisture flowing to a surface of each guide plate 71 may be downwardly guided along the guide plate 71. It may be difficult for moisture to be condensed on opposite lateral edges of each guide plate 71. The guide plates 71 are effective in suppression of frost formation in that they are advantageous in drainage of condensed water.

The increased number of the guide plates 71 results in an enhancement in moisture drainage effects. The guide plates 71 may be bent to have multiple steps in the width direction of the guide plates 71 in order to increase the number of the guide plates 71 included in the louver 70. According to an exemplary embodiment, as illustrated in FIG. 5, each guide plate 71 may have a structure bent to have two steps such that first and second bent portions 71*a* and 71*b* are formed at opposite ends of the guide plate 71 in the width direction of the guide plate 71, respectively. The first and second bent portions 71*a* and 71*b* may downwardly guide moisture on the surface of the guide plate 71 after collecting the moisture, as in the moisture guide valleys 50. In an exemplary heat exchanging fin 30 in which condensed water flowing in an insertion direction of each refrigerant tube 20 is downwardly drained through the corresponding first moisture guide valley 51, the louver 70 may be arranged in the vicinity of the end of the fitting slot 31 opposite to the first moisture guide valley 51 in order to drain condensed water flowing in a direction opposite to the insertion direction of the refrigerant tube 20.

Figure 7:
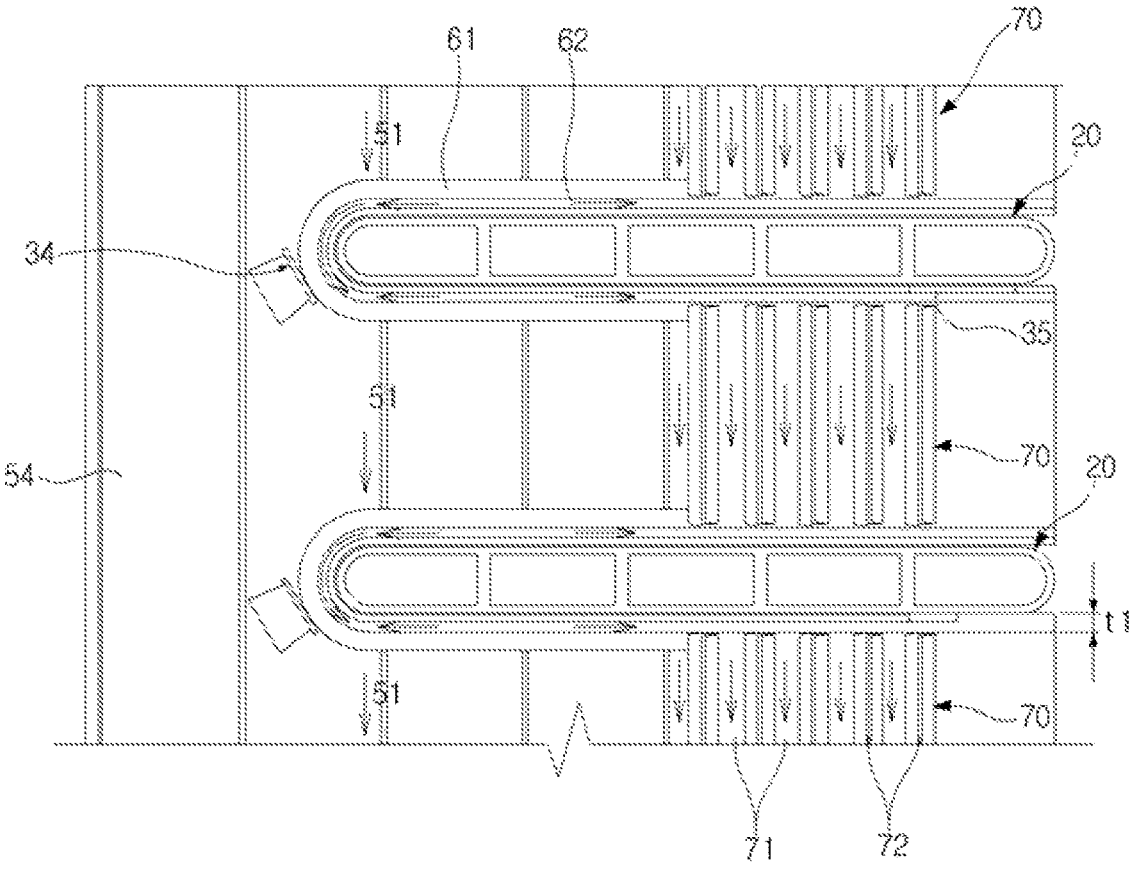
FIG. 7 is an exemplary plan view of a heat exchanging fin, illustrating exemplary condensed water guide directions.

In order to directly guide, to the guide plates 71, moisture present at positions adjacent to the surfaces of the corresponding refrigerant tubes 20, opposite longitudinal ends of each guide plate 71 may be disposed adjacent to the corresponding refrigerant tubes 20, for example, to a maximum possible extent. As illustrated in FIG. 7, for example, according to an exemplary embodiment, the moisture guide surface 612 may be disposed within a region where the louver 70 is disposed and, as such, each guide plate 71 is directly connected with the flat surface 624. When each guide plate 71 is near the refrigerant tubes 20, there may be a possibility that resistance of air flowing around the refrigerant tubes 20 may be excessively decreased. To address this potential issue, according to an exemplary embodiment, a distance from the guide plate 71 to each refrigerant tube 20, namely, "t1", may range from 0.5 mm to 1.0 mm, taking into consideration desired moisture drainage effects and resistance of air around the refrigerant tube 20. Within this range, critical effects may be generated.

An exemplary condensed water drainage operation of the heat exchanging fins 30 is disclosed. In FIG. 7, exemplary flow directions of condensed water formed on the surfaces of the heat exchanging fins are indicated by arrows.

Condensed water formed on the surfaces of each heat exchanging fin 30 may be guided to the plural moisture guide valleys 50 formed to extend vertically at the front and back surfaces of the heat exchanging fin 30 and, as such, is guided from above to below.

Condensed water flowing downward along the surfaces of the refrigerant tubes 20 or the surfaces of each heating exchanging fin 30 may be guided to the guide grooves 63 and moisture guide surfaces 61 and, as such, flow of condensed water in the width direction of the refrigerant tubes 20 is promoted.

Condensed water flowing along each guide groove 63 in the insertion direction of each refrigerant tube 20 is rapidly downwardly drained after being guided to the corresponding first moisture guide valley 51. According to an exemplary embodiment, condensed water present around each first spacer 34 may be guided to the corresponding moisture guide valley 51 via the inclined surface 34*b* of the first spacer 34, and then downwardly guided along the first moisture guide valley 51 after being collected together with condensed water guided from the corresponding refrigerant tube 20.

According to an exemplary embodiment, condensed water flowing along each guide groove 63 in a direction opposite to the insertion direction of each refrigerant tube 20 may be rapidly downwardly drained after being guided to, for example, the corresponding louver 70. Condensed water downwardly guided via the louver 70 may be guided toward the corresponding first moisture valley 51 along the corresponding guide groove 63, or downwardly guided in a continuous manner via louvers 70 disposed below the louver 70 and, as such may be drained toward the lower end of the heat exchanging fin 30.

Thus, the heat exchanging fins 30 according to an exemplary embodiment may effectively suppress formation of frost by continuously downwardly guiding condensed water formed on the surfaces of the heat exchanging fins 30 without interruption.

Figure 8:
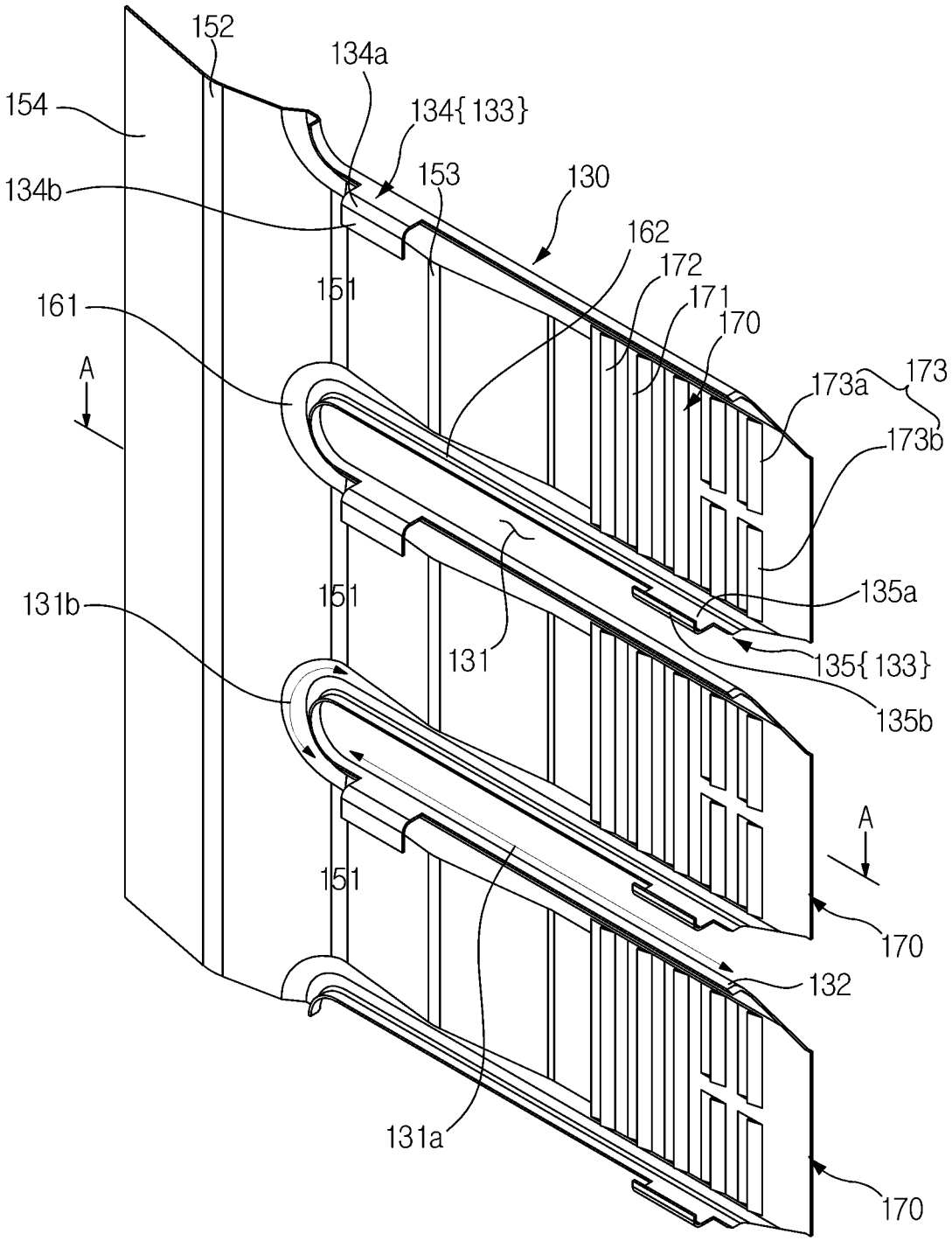
FIG. 8 illustrates a heat exchanging fin according to an embodiment of the present invention.
Figure 9:
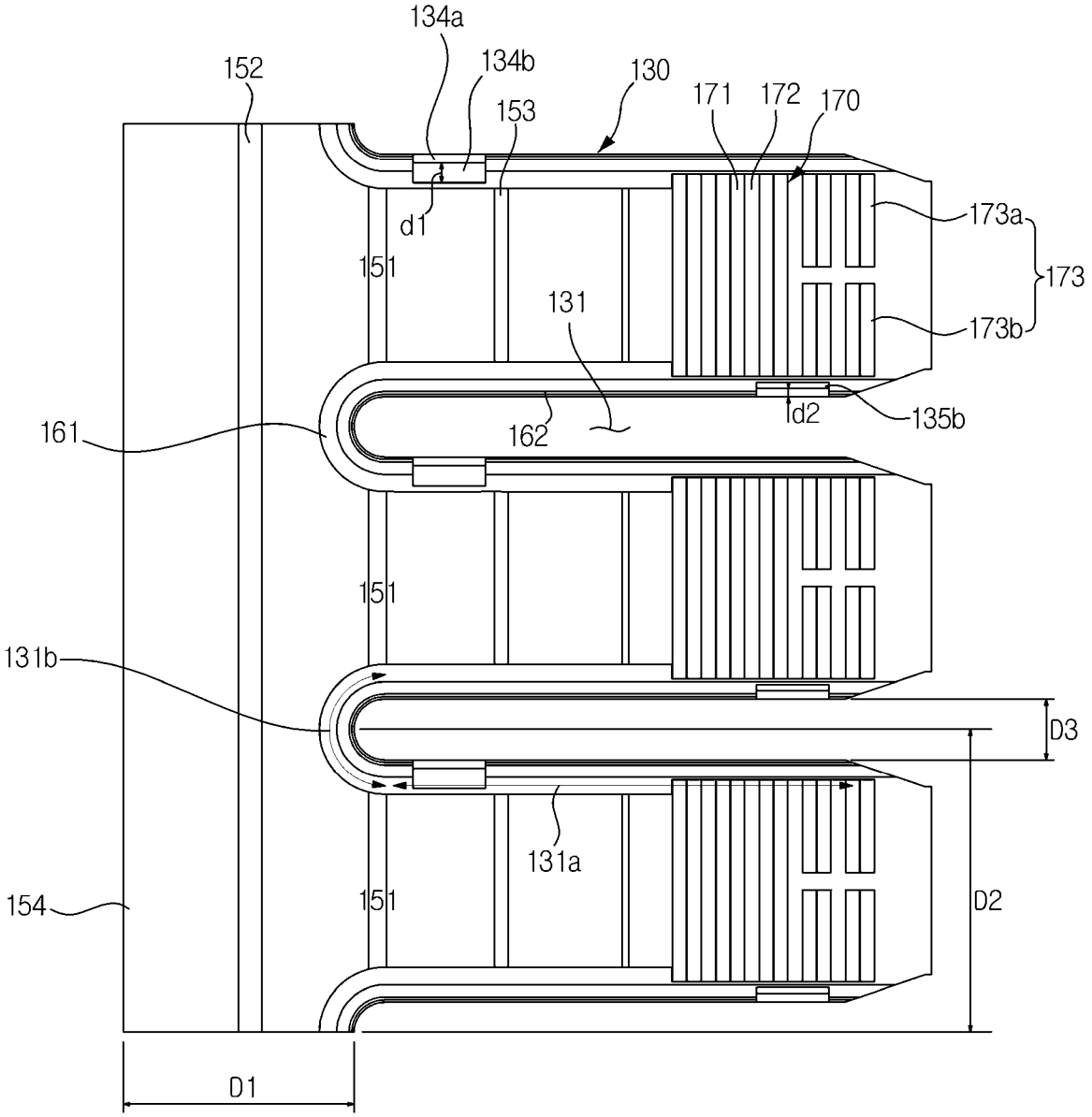
FIG. 9 is an exemplary plan view of the heat exchanging fin illustrated in FIG. 8.
Figure 10:
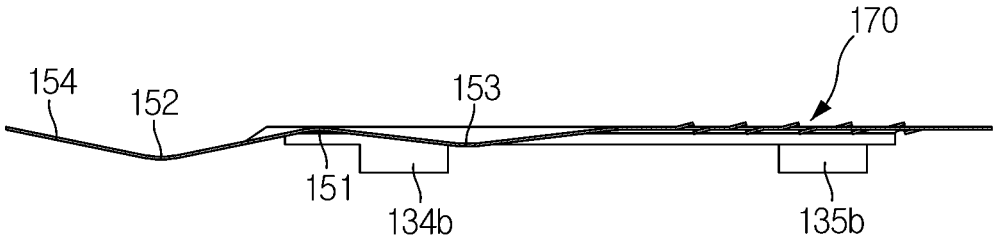
FIG. 10 is an exemplary cross-sectional view taken along line A-A in FIG. 8.

FIG. 8 illustrates an exemplary heat exchanging fin according to an embodiment of the present invention. FIG. 9 is an exemplary plan view of the heat exchanging fin illustrated in FIG. 8. FIG. 10 is an exemplary cross-sectional view taken along line A-A in FIG. 8.

Referring to FIGS. 8 to 10, a heat exchanging fin 130 is illustrated. The heat exchanging fin 130 includes fitting slots 131, in which respective refrigerant tubes 20 (see, for example, FIG. 1) may be fitted, and moisture guide valleys 151, 152, and 153 to guide moisture. As illustrated, for example, in FIGS. 8-9 according to an exemplary embodiment, at least one of the moisture guide valleys 151 has at least one side arranged along a virtual line extending through a curved portion of at least one of the fitting slots 131. Around each fitting slot 131, a contact rib 132, a moisture guide surface 161, and a flat surface 162, which are similar to those of the previous embodiment, may be provided. Each fitting slot 131 may include opposite straight portions 131*a* and a curved portion 131*b*. The curved portion 131*b* may connect the opposite straight portions 131*a*.

A spacer 133 may be provided at each fitting slot 131. The spacer 133 may include a first spacer 134 and a second spacer 135. The first spacer 134 and second spacer 135 may be disposed at opposite sides of the corresponding fitting slot 131. The first spacer 134 and second spacer 135 may be arranged to be misaligned with each other. According to an exemplary embodiment of the present invention, the first spacer 134 may be arranged to be closer to a curved portion 131*b* of the fitting slot 131 than the second spacer 135. According to an exemplary embodiment of the present invention, the second spacer 135 may be arranged at one lateral end of a louver 170. Exemplary embodiments of the present invention are not limited to the above-described arrangements.

The first spacer 134 and second spacer 135 may include extensions extending from the fitting slot 131 toward the heat exchanging fin 120, for example, a first extension 134*b* and a second extension 135*b*, respectively. The sum of the widths of the first and second extensions 134*b* and 135*b* may be approximately 60% or more of the width of the fitting slot 131. Accordingly, it may be possible to uniformly space the heat exchanging fins 130 by a predetermined distance when the heat exchanging fins 130 are stacked, and to prevent one heat exchanging fin 130 from being caught by another heat exchanging fin 130 during coupling of the heat exchanging fins 130 with the refrigerant tubes 20 (see, for example, FIG. 1).

According to an exemplary embodiment of the present invention, the first extension 134*b* has a width D1 of 1 mm, whereas the second extension 135*b* has a width D2 of 0.5 mm. That is, the width D1 of the first extension 134*b* may be greater than the width D2 of the second extension 135*b*.

The louver 170 may be provided at a portion of the heat exchanging fin 130 opposite to a protrusion 154 provided at one lateral end of the heat exchanging fin 130. The louver 170 may include a plurality of guide plates 172.

According to an embodiment of the present invention, the louver 170 may include a first louver 171 including one guide plate 172 for each column, and a second louver 173 including two guide plates 173*a* and 173*b* spaced apart from each other for each column. That is, two second louvers 173 may be arranged for each column. The second louvers 173 may be arranged to be closer to one lateral end of the heat exchanging fin 130 than the first louver 171. In an embodiment of the present invention, the first louver 171 may be arranged in a first region where at least a portion of the moisture guide surface 161 is disposed. The second louver 173 may be arranged in a region other than the first region, namely, a second region. The moisture guide surface 161 may be formed by subjecting a desired surface portion of the heat exchanging fin 130 to a burring process. The second louver 173 may be arranged in the second region where surface portions of the heat exchanging fin 130 not subjected to a burring process are disposed.

According to an exemplary embodiment, no burring process is carried out for the second region to improve fitability of the refrigerant tubes 20 (see, for example, FIG. 1). When one louver is arranged for each column in the second region, strength of the heat exchanging fin may be reduced due to the guide plates formed through cutting. As illustrated in FIG. 8, for example, according to an exemplary embodiment of the present invention, two second louvers 173 spaced apart from each other may be provided for each column and, as such, it may be possible to secure desired strength of the heat exchanging fin 130 even in the second region where no burring process is carried out.

As illustrated in FIG. 9, "D1" represents the length of the protrusion 154 of the heat exchanging fin 130, "D2" represents the width of each fin portion of the heat exchanging fin 130 between adjacent fitting slots 131, and "D3" represents a maximum width of each fitting slot 131. A width D2 of each fin portion of the heat exchanging fin 130 may be defined as a distance from an intermediate point of one fitting slot 131 to an intermediate point of another fitting slot 131 adjacent to the former fitting slot 131. Among D1, D2, and D3, a relation expressed by the following Expression 1 may be established.

$$(D1*D2)\hat{}0.3/D3>1.5 \qquad \text{[Expression 1]}$$

In accordance with Expression 1, it may be possible to prevent formation of moisture on the heat exchanging fin 130. That is, when the protrusion 154 has an increased length D1, and air paths having an increased width D2 are provided, formation of frost may be further suppressed. When the length D1 of the protrusion 154 increases, manufacturing costs may be increased. When the width D2 of the air paths increases, electric efficiency may be degraded. Accordingly, it may be necessary to provide a relation between the factors, for example, a relation of "D2-D3".

A time taken for formation of frost may be measured under the condition that three factors D1, D2, and D3 are adjusted. Exemplary results of the measurement are disclosed in the following Table 1:

| | D1 | D2 | D3 | Frost Formation Time |
|---|---|---|---|---|
| Example 1 | 0 | 10.5 | 2.3 | 29 |
| Example 2 | 7 | 10.5 | 2.3 | 37 |
| Example 3 | 10.8 | 10.5 | 2.3 | 47 |
| Example 4 | 8 | 10.5 | 2.1 | 48 |

When values of Example 1 in Table 1 are applied to Expression 1, a relation of 0 is established. When values of Example 2 in Table 1 are applied to Expression 1, a relation of 1.58 is established. When values of Example 3 in Table 1 are applied to Expression 1, a relation of 1.8 is established. When values of Example 4 in Table 1 are applied to Expression 1, a relation of 1.8 is established. That is, the relation expressed in Expression 1 is established in Examples 2 to 4. However, the relation expressed in Expression 1 is not established in Example 1. From such measurement results, it may be seen that, in Example 1, the time taken for formation of frost on the heat exchanging fin is short.

Figure 11A:
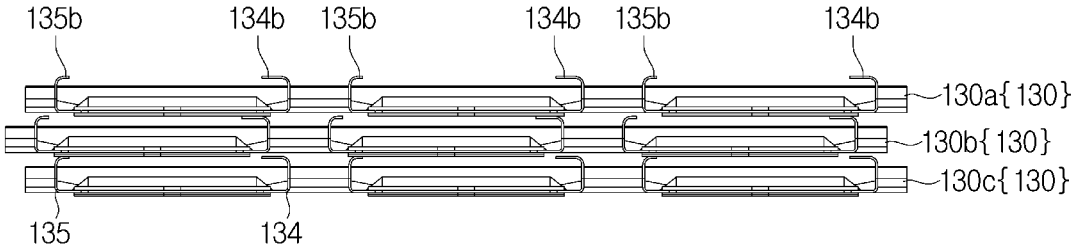
FIG. 11A is a view illustrating heat exchanging fins stacked in a misaligned state.
Figure 11B:
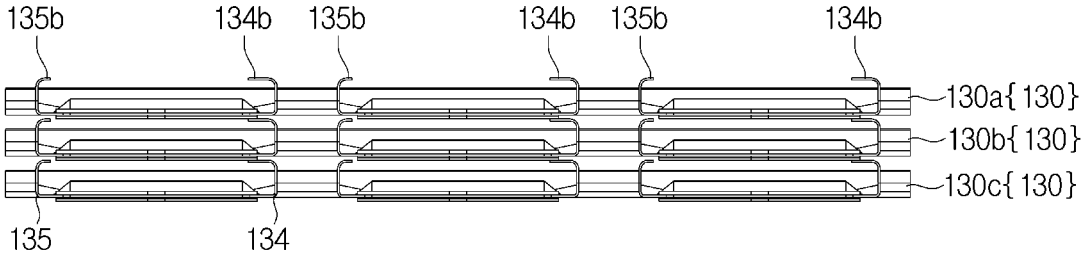
FIG. 11B is a view illustrating heat exchanging fins normally stacked in an aligned state.

FIG. 11A is a view illustrating an exemplary case in which heat exchanging fins having a configuration of FIG. 8 are stacked in a misaligned state. FIG. 11B is a view illustrating an exemplary case in which the heat exchanging fins of FIG. 8 are normally stacked in an aligned state.

As illustrated in FIGS. 11A and 11B, heat exchanging fins 130*a*, 130*b*, and 130*c* may be uniformly spaced apart from one another by a predetermined distance by the spacers 134 and 135 even when the heat exchanging fins 130*a*, 130*b*, and 130*c* are stacked in a misaligned state due to movement thereof.

According to an embodiment of the present invention, the first extension 134*b* of each first spacer 134 and the second extension 135*b* of each second spacer 135 have different widths. Exemplary embodiments of the present invention are not limited to such a condition.

Figure 12A:
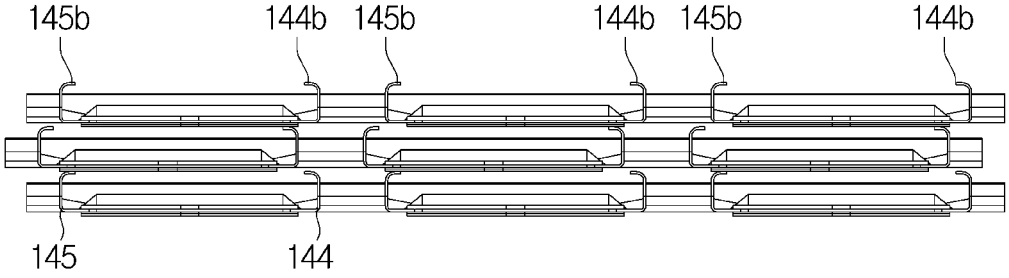
FIG. 12A is a view illustrating heat exchanging fins according to an embodiment of the present invention stacked in a misaligned state.
Figure 12B:
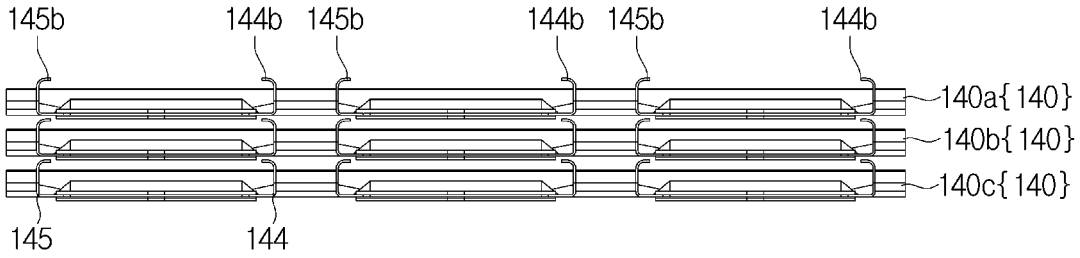
FIG. 12B is a view illustrating heat exchanging fins normally stacked in an aligned state.

FIG. 12A is a view illustrating an exemplary case in which heat exchanging fins according to an embodiment of the present invention are stacked in a misaligned state. FIG. 12B is a view illustrating an exemplary case in which the heat exchanging fins of FIG. 12A are normally stacked in an aligned state.

According to an exemplary embodiment of the present invention illustrated in FIGS. 12A and 12B, the first extension 144*b* of each first spacer 144 and the second extension 145*b* of each second spacer 145 have the same width, for example, a width of 0.5 mm. Even when the first extension 144*b* of each first spacer 144 and the second extension 145*b* of each second spacer 145 have the same width, it may be possible to prevent one heat exchanging fin 140 from being caught by another heat exchanging fin 140, so long as the width of the extensions 144*b* and 145*b* is equal to or greater than a predetermined width.

As apparent from the above description, in accordance with aspects of the present invention, it may be possible to enhance heat exchange efficiency of a heat exchanger through suppression of formation of frost on surfaces of heat exchanging fins.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heat exchanger comprising:

a plurality of refrigerant tubes vertically spaced apart from one another; and a plurality of heat exchanging fins spaced apart from one another in a longitudinal direction of the plurality of refrigerant tubes, the plurality of heat exchanging fins coupled to a surface of a corresponding refrigerant tube among the plurality of refrigerant tubes, wherein a heat exchanging fin among the plurality of heat exchanging fins comprises:

a plurality of fitting slots horizontally formed at one lateral end of the heat exchanging fin and vertically arranged, the plurality of fitting slots having a curved portion and a straight portion with an opening to receive the corresponding refrigerant tube of the plurality of refrigerant tubes, a plurality of moisture guide valleys to guide moisture formed on a surface of the heat exchanging fin, a contact rib extending around a corresponding fitting slot in a longitudinal direction of the corresponding refrigerant tube and configured to contact the surface of the corresponding refrigerant tube, a plurality of moisture guide surfaces extending around corresponding ones of the plurality of fitting slots, flat surfaces each provided between a corresponding one of contact ribs and a corresponding one of the moisture guide surfaces, to be perpendicular to a corresponding one of the refrigerant tubes, and a plurality of louvers provided between adjacent ones of the fitting slots, the plurality of louvers including a plurality of first louvers comprising one guide plate per column between adjacent ones of the plurality of fitting slots, the plurality of first louvers being of a same length, and a plurality of second louvers comprising two guide plates spaced apart from each other per column between the adjacent ones of the plurality of fitting slots, wherein a moisture guide valley among the plurality of moisture guide valleys is arranged along a virtual line extending through the curved portion of at least one fitting slot among the plurality of fitting slots, wherein the plurality of moisture guide valleys are arranged in a first location where at least a portion of corresponding ones of the plurality of moisture guide surfaces are disposed, and the plurality of louvers are arranged in a second location other than the first location, wherein the louvers are arranged in a vicinity of an end of the fitting slot opposite to the plurality of moisture guide valleys, and is directly connected with the flat surface, wherein at least one heat exchanging fin among the plurality of heat exchanging fins further comprises a spacer protruded from the surface of the at least one heat exchanging fin, the spacer configured to space the at least one heat exchanging fin from another heat exchanging fin by a predetermined distance, wherein the at least one heat exchanging fin further comprises the spacer and another spacer, and a corresponding one of the fitting slots is disposed between the spacer and the other spacer, and wherein:

the spacer and the other spacer comprise extensions extending from the corresponding fitting slot toward the at least one heat exchanging fin, respectively; and a sum of widths of the extensions in the space and the other spacer is 60% or more of a width of the corresponding fitting slot.

2. The heat exchanger according to claim 1, wherein at least one of the plurality of moisture guide valleys further comprises a first moisture guide valley and a second moisture guide valley configured to guide moisture to the first moisture guide valley.

3. The heat exchanger according to claim 1, wherein at least one heat exchanging fin among the plurality of heat exchanging fins comprises a protrusion protruded in a direction away from at least one of the plurality of refrigerant tubes, and wherein at least one moisture guide valley among the plurality of moisture guide valleys comprises a first moisture guide valley and a second moisture guide valley closer to the protrusion than the first moisture guide valley.

4. The heat exchanger according to claim 1, wherein:

the corresponding one of the moisture guide surfaces is extended around the corresponding fitting slot outside the corresponding contact rib while being inclined toward the corresponding contact rib, and intersecting at least one of the plurality of moisture guide valleys.

5. The heat exchanger according to claim 1, wherein the spacer provided on a virtual line horizontally extending from a corresponding one of the fitting slots in an insertion direction of the plurality of refrigerant tubes.

6. The heat exchanger according to claim 1, wherein the spacer is arranged to be closer to the curved portion of the corresponding fitting slot than the other spacer.

7. The heat exchanger according to claim 1, wherein:

the one guide plate of the plurality of first louvers and the two guide plates of the plurality of second louvers are parallel to a corresponding one of the moisture guide valleys, and bent to have multiple steps in a width direction.

8. A heat exchanger comprising:

a plurality of refrigerant tubes vertically spaced apart from one another; and a plurality of heat exchanging fins spaced apart from one another in a longitudinal direction of the plurality of refrigerant tubes, the plurality of heat exchanging fins coupled to the plurality of refrigerant tubes, wherein a heat exchanging fin among the plurality of heat exchanging fins comprises:

a plurality of fitting slots horizontally formed at one lateral end of the heat exchanging fin and vertically arranged, the plurality of fitting slots having a curved portion and a straight portion with an opening to receive a corresponding refrigerant tube of the plurality of refrigerant tubes; and a plurality of moisture guide valleys to guide moisture formed on a surface of the heat exchanging fin, wherein a moisture guide valley among the plurality of moisture guide valleys arranged along a virtual line extending through a boundary between the curved portion and the straight portion of at least one fitting slot among the plurality of fitting slots, wherein at least one of the plurality of heat exchanging fins further comprises a spacer protruded from the surface of the at least one heat exchanging fin, to space the at least one heat exchanging fin from another heat exchanging fin by a predetermined distance, wherein the spacer comprises a first spacer and a second spacer, and a corresponding one of the fitting slots is disposed between the first spacer and the second spacer, wherein the first spacer is arranged to be closer to the curved portion of the corresponding fitting slot than the second spacer, wherein the first spacer and the second spacer comprise extensions extending from the corresponding fitting slot toward the at least one heat exchanging fin, respectively, and a sum of widths of the extensions in the first and second spacers is 60% or more of a width of the corresponding fitting slot, and wherein the width of the extension of the first spacer is greater than the width of the extension of the second spacer.

9. A heat exchanger comprising:

a plurality of refrigerant tubes vertically spaced apart from one another; and a plurality of heat exchanging fins spaced apart from one another in a longitudinal direction of the plurality of refrigerant tubes, the plurality of heat exchanging fins coupled to the plurality of refrigerant tubes, wherein a heat exchanging fin among the plurality of heat exchanging fins comprises:

a plurality of fitting slots horizontally formed at one lateral end of the heat exchanging fin and vertically arranged, the plurality of fitting slots having a curved portion and a straight portion with an opening to receive a corresponding refrigerant tube of the plurality of refrigerant tubes; and a plurality of moisture guide valleys to guide moisture formed on a surface of the heat exchanging fin, wherein a moisture guide valley among the plurality of moisture guide valleys arranged along a virtual line extending through a boundary between the curved portion and the straight portion of at least one fitting slot of the plurality of fitting slots, wherein at least one heat exchanging fin of the plurality of heat exchanging fins further comprises louvers provided between adjacent ones of the fitting slots, wherein the louvers comprise a plurality of guide plates extending in parallel with a corresponding one of the plurality of moisture guide valleys while being spaced apart from one another in a longitudinal direction of the fitting slots, and at least one guide plate among the plurality of the guide plates is bent to have multiple steps in a width direction of the at least one guide plate, wherein the louvers comprise a first louver having one guide plate for each column, and a second louver having two guide plates spaced apart from each other for each column, wherein at least one heat exchanging fin of the plurality of heat exchanging fins further comprises moisture guide surfaces extending around a corresponding one of the fitting slots while being inclined toward the corresponding fitting slot, and wherein the first louver is arranged in a first region where at least a portion of a corresponding one of the moisture guide surfaces is disposed, and the second louver is arranged in a second region other than the first region.

10. A heat exchanger comprising:

a plurality of refrigerant tubes vertically spaced apart from one another; and a plurality of heat exchanging fins spaced apart from one another in a longitudinal direction of the plurality of refrigerant tubes, the plurality of heat exchanging fins coupled to the plurality of refrigerant tubes, wherein a heat exchanging fin among the plurality of heat exchanging fins comprises:

a plurality of fitting slots horizontally formed at one lateral end of the heat exchanging fin and vertically arranged, each of the plurality of fitting slots having a curved portion and a straight portion with an opening to receive a corresponding refrigerant tube of the plurality of refrigerant tubes;

a protrusion protruded in a direction away from the plurality of refrigerant tubes; and a plurality of moisture guide valleys to guide moisture formed on a surface of the heat exchanging fin, wherein a moisture guide valley among the plurality of moisture guide valleys comprises a first moisture guide valley arranged along a virtual line extending through a boundary between the curved portion and the straight portion of the fitting slot, and a second moisture guide valley to guide moisture to the first moisture guide valley, and wherein a relation of $(D1*D2)\hat{}0.3/D3>1.5$ is established where "D1" represents a length of the protrusion, "D2" represents a width of each fin portion of the heat exchanging fin between an intermediate point of one fitting slot and an intermediate point of another fitting slot adjacent to the former fitting slot, and "D3" represents a maximum width of the fitting slots.

11. A heat exchanger comprising:

a plurality of refrigerant tubes vertically spaced apart from one another; and a plurality of heat exchanging fins spaced apart from one another in a longitudinal direction of the plurality of refrigerant tubes, the plurality of heat exchanging fins coupled to the plurality of refrigerant tubes, wherein a heat exchanging fin among the plurality of heat exchanging fins comprises a plurality of fitting slots horizontally formed at one lateral end of the heat exchanging fin and vertically arranged, the plurality of fitting slots having a curved portion and a straight portion with an opening to receive the corresponding refrigerant tube of the plurality of refrigerant tubes, a plurality of moisture guide valleys to guide moisture formed on surfaces of the heat exchanging fin, a contact rib extending around a corresponding fitting slot in a longitudinal direction of the corresponding refrigerant tube and configured to contact the surface of the corresponding refrigerant tube, a plurality of moisture guide surfaces extending around corresponding ones of the plurality of fitting slots, flat surfaces each provided between a corresponding one of the contact ribs and a corresponding one of the moisture guide surfaces, to be perpendicular to a corresponding one of the refrigerant tubes, and a plurality of louvers provided between adjacent ones of the fitting slots, the plurality of louvers including a plurality of first louvers comprising one guide plate per column between adjacent ones of the plurality of fitting slots, the plurality of first louvers being of a same length, a plurality of second louvers comprising two guide plates spaced apart from each other per column between the adjacent ones of the plurality of fitting slots, and a plurality of spacers protruded from a surface of the heat exchanging fin to space the heat exchanging fin from another heat exchanging fin by a predetermined distance, wherein the plurality of spacers comprise a first spacer and a second spacer in a vicinity of a corresponding one of the plurality of fitting slots and arranged in an insertion direction of the plurality of refrigerant tubes, wherein a moisture guide valley among the plurality of moisture guide valleys arranged along a virtual line extending through the curved portion of at least one fitting slot among the plurality of fitting slots, wherein the plurality of moisture guide valleys are arranged in a first location where at least a portion of corresponding ones of the plurality of moisture guide surfaces are disposed, and the plurality of louvers are arranged in a second location other than the first location, and wherein the louvers are arranged in a vicinity of an end of the fitting slot opposite to the plurality of moisture guide valleys, and is directly connected with the flat surface, and wherein:

the first spacer and the second spacer comprise extensions extending from the corresponding fitting slot toward the heat exchanging fin, respectively; and a sum of widths of the extensions in the first spacer and the second spacer is 60% or more of a width of the corresponding fitting slot.

12. The heat exchanger according to claim 11, wherein the first spacer is arranged in the vicinity of a curved portion of the corresponding fitting slot.

13. The heat exchanger according to claim 11, wherein the first spacer is arranged in a vicinity of a straight portion of the corresponding fitting slot.

14. A heat exchanger comprising:

a plurality of refrigerant tubes vertically spaced apart from one another; and a plurality of heat exchanging fins spaced apart from one another in a longitudinal direction of the plurality of refrigerant tubes, the plurality of heat exchanging fins being coupled the plurality of refrigerant tubes, wherein a heat exchanging fin among the heat exchanging fins comprises:

a plurality of fitting slots horizontally formed at one lateral end of the heat exchanging fin and vertically arranged to receive the plurality of refrigerant tubes; and a protrusion protruded in a direction away from the plurality of refrigerant tubes, wherein a relation of (D1*D2)^0.3/D3>1.5 is established where "D1" is a length of the protrusion of the heat exchanging fin, "D2" is a width of a portion of the heat exchanging fin between an intermediate point of one fitting slot and an intermediate point of another fitting slot adjacent to the former fitting slot, and "D3" is a maximum width of a slot of the plurality of fitting slots.

15. The heat exchanger according to claim 14, wherein:

the heat exchanging fin comprises a plurality of moisture guide valleys to guide moisture formed on surfaces of the heat exchanging fin, and a moisture guide valley among the plurality of moisture guide valleys comprises a first moisture guide valley arranged along a virtual line extending through a boundary between a curved portion of a corresponding one of the fitting slots and each straight portion of the fitting slot, and a second moisture guide valley arranged to be closer to the protrusion than the first moisture guide valley, to guide moisture to the first moisture guide valley.

16. The heat exchanger according to claim 15, wherein:

the heat exchanging fin further comprises a contact rib extending around the corresponding one of the fitting slots in a longitudinal direction of a corresponding one of the refrigerant tubes, to contact the surface of the corresponding refrigerant tube, and a plurality of moisture guide surfaces extending around a corresponding one of the fitting slots outside a corresponding one of the contact ribs while being inclined toward the corresponding contact rib, and the plurality of moisture guide surfaces intersecting the first moisture guide valley of a corresponding one of the plurality of moisture guide valleys.

17. The heat exchanger according to claim 14, wherein the heat exchanging fin further comprises at least one spacer protruded from the surface of the heat exchanging fin, to space the heat exchanging fin from another heat exchanging fin by a predetermined distance.

18. The heat exchanger according to claim 14, wherein:

the exchanging fin further comprises a plurality of louvers provided between adjacent ones of the fitting slots, the plurality of louvers comprise a plurality of guide plates spaced apart from one another in a longitudinal direction of the fitting slots, and at least one of the plurality of guide plates is bent to have multiple steps in a width direction of the guide plates.

19. The heat exchanger according to claim 18, wherein at least one of the plurality of louvers comprises a first louver having one guide plate for each column, and a second louver having two guide plates spaced apart from each other for each column.

* * * * *